United States Patent [19]

Bassett et al.

[11] 4,162,856

[45] Jul. 31, 1979

[54] AGITATION APPARATUS

[75] Inventors: William W. Bassett, Wayzata; Eugene D. Johnson, Spring Lake Park, both of Minn.

[73] Assignee: Honeywell Inc., Minneapolis, Minn.

[21] Appl. No.: 868,659

[22] Filed: Jan. 11, 1978

Related U.S. Application Data

[63] Continuation of Ser. No. 689,879, May 25, 1976, abandoned.

[51] Int. Cl.[2] ..... B01F 9/02

[52] U.S. Cl. ..... 366/213

[58] Field of Search ..... 366/198, 200, 204, 206, 366/207, 218, 209, 220, 213, 214

[56] References Cited

U.S. PATENT DOCUMENTS

| | | | |
|---|---|---|---|
| 3,163,404 | 12/1964 | Kraft | 259/57 |
| 3,439,871 | 4/1969 | Unger | 233/26 |
| 3,600,900 | 8/1971 | Buddecke | 233/26 |
| 3,777,652 | 12/1973 | Engel | 259/57 |
| 3,825,178 | 7/1974 | Burg | 233/26 |
| 3,891,140 | 6/1975 | Ayres | 233/26 |

*Primary Examiner*—Robert W. Jenkins

*Attorney, Agent, or Firm*—Charles G. Mersereau

[57] ABSTRACT

An improved apparatus for mixing fluids in sealed containers, such as blood samples in test tubes or the like, is disclosed which includes a support structure on which a motor-driven rotatable mixing disc is mounted. The disc is provided with integral recesses in the shape of the sealed containers to be agitated and is disposed at an angle such that the containers are retained in the recesses by gravity. In the preferred embodiment, the recesses are radially disposed on the disc and are so designed as to receive interchangeably a plurality of lengths of test tubes.

6 Claims, 3 Drawing Figures

AGITATION APPARATUS

This is a continuation of application Ser. No. 689,879, filed May 25, 1976, now abandoned.

BACKGROUND OF THE INVENTION

1. FIELD OF THE INVENTION

The present invention relates generally to the mixing of small quantities of fluid samples in sealed containers such as vials or sealed test tubes and, more particularly, to the mixing of biological specimens, such as blood, prior to the withdrawal of samples for biological testing.

2. DESCRIPTION OF THE PRIOR ART

The in vitro diagnostic testing of samples of whole blood or certain constituents thereof such as the differential counting of the various types of leukocytes (white blood cells) has long been a valuable medical tool in determining the presence of disease or other abnormalities in both man and animals. Such tests usually involve small quantities of blood taken from the specimen withdrawn from a patient. In order for test results to be reliable, the samples used must be as representative of the patient's blood as possible.

Generally, a specimen of blood withdrawn from a patient is placed in a sealed vial or test tube containing an amount of an anti-coagulant and/or a fixative or other preservative agent. Test samples are then withdrawn from the larger specimen as needed.

Because unmixed whole blood has a tendency to separate into layers of its constituents, in order for any subsequent sample withdrawn from the specimen to be representative of the original, the original sample must be thoroughly mixed and is preferably maintained in an agitated state.

Several types of devices have been used to maintain biological samples such as whole blood in homogenized condition. One such prior art device is illustrated and described in U.S. Pat. No. 3,747,900 to Dilts dated July 24, 1973. That device comprises d.c. motor-driven, vertical plate to which clips for holding tubes or vials containing the fluid to be mixed are attached by permanent magnets or adhesive nylon strips. Another such prior art device which utilizes an adjustably tiltable, motor-driven rotating disc member having a plurality of vial or test tube holding clips permanently secured thereto is disclosed in U.S. Pat. No. 3,163,404 to Kraft, et al., dated Dec. 29, 1964.

While both of these prior art devices may successfully mix fluids, they suffer from several disadvantages. Generally the clips can accommodate tubes only of a specified diameter, and after a time the clips lose their resiliency and must be replaced. The necessity of using clips at all increases the amount of handling required because the vials or tubes must be inserted and removed from the clips. This, of course, increases the likelihood of vial or tube breakage. Also, in the case of permanently attached clips, it is quite difficult to add or remove tubes to the disc while the disc is operating.

SUMMARY OF THE INVENTION

By means of the present invention, the disadvantages associated with prior art mixers are overcome by the provision of a rotatable agitating member, which may be in the shape of a disc, and which contains recesses to receive containers of fluid to be agitated. The disc is mounted at such an angle that the containers such as test tubes or vials are supported in the recesses without the need for any auxiliary supporting means. In the preferred embodiment, the disc is motor-driven and mounted at an angle fixed by a supportive structure. The recesses in the disc are normally radially disposed and may be shaped to receive several sizes of sealed containers such as different lengths of test tubes or the like. The elimination of the need for any auxiliary mounting members to hold the containers to be mixed on the mixing disc simplifies the apparatus and adds greatly to the ease of handling of the containers. Also, there is no need to stop the rotation of the disc during placement and removal.

BRIEF DESCRIPTION OF THE DRAWINGS

In the drawings, wherein like numerals are utilized to designate like parts throughout the same.

DESCRIPTION OF THE PREFERRED EMBODIMENT

Figure 1:
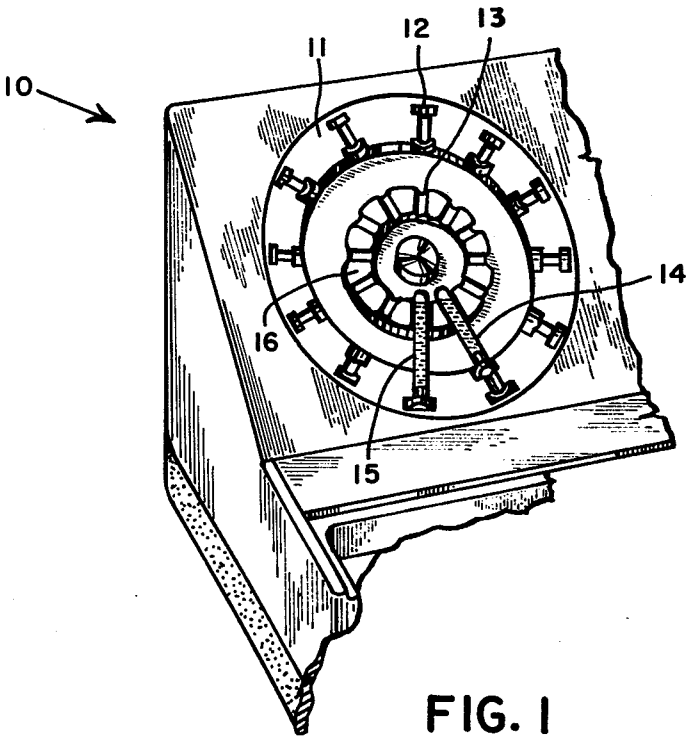
FIG. 1 is a partially cut away perspective view of an embodiment of the present invention.

In FIG. 1 there is illustrated a partially cut away perspective view of a console model of the invention. This includes a supporting case structure 10 rotatable agitating disc 11 containing a plurality of shaped outer recesses 12 and corresponding inner recesses 13 which may be disposed radially about the disc 11. The recesses 12 are normally in the shape of the containers to be received and may be designed such that several conventional styles sizes of sealed containers such as vials or test tubes may be received interchangeably. There are illustrated at 14 and 15 two conventional sizes, e.g., 5 ml (12 mm×75 mm) or 7 ml (13 mm×100 mm) of sealed test tubes which may be Vacutaners (trademark of Becton-Dickenson and Company of Rutherford, New Jersey) or similar tubes.

The recesses 13 may have a shape similar to the recesses 12 or may be determined by intermediate raised areas as at 16. As illustrated in the perspective view of FIG. 1, the agitating disc 11 is mounted generally at an angle such that the tubes when placed in the recesses 12 and 13 are retained there by gravity eliminating the need for any auxiliary devices to hold them in place. While the supporting console structure 10 may be designed to support the agitating disc 11 at any angle which will allow the tubes to be retained in their recesses 12 and 13 by gravity, and generally any angle between 30° and 60° will suffice, mixing studies have shown that the most efficient mixing occurs at an angle of approximately 45°. Likewise, the rate of ratoation is not critical. Thus, any rate which accomplishes a continual gentle agitation of the blood is acceptable. Generally, a rate between about 4 rpm and 16 rpm is preferred. One successful embodiment rotates at a fixed speed of approximately 6 rpm.

Figure 3:
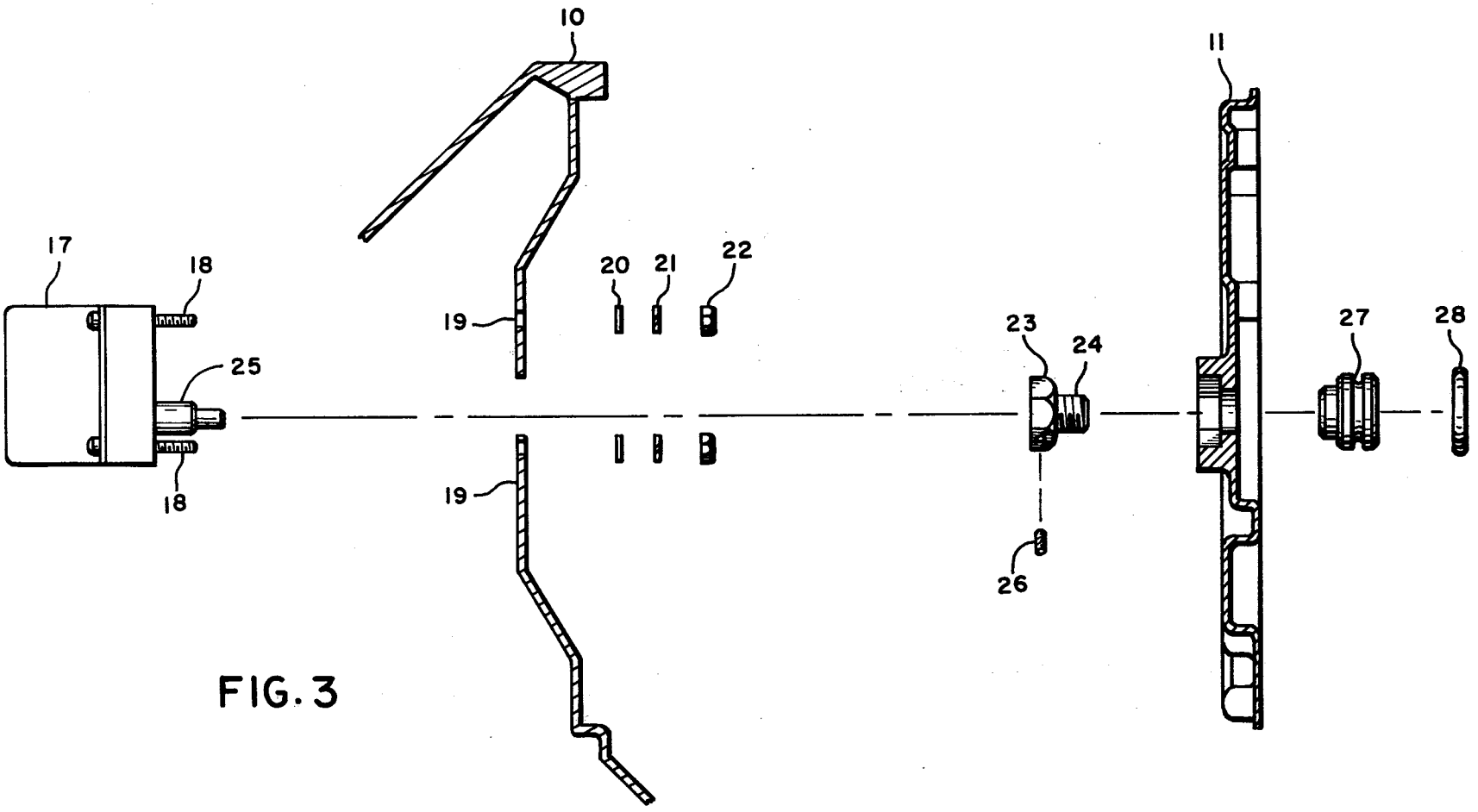
FIG. 3 is an exploded view partially in section showing the assembly of the apparatus of the present invention.

In FIG. 3 a typical assembly of the mixing or agitation apparatus of the present invention is shown in exploded form, partially in section. A partial view of the support structure or console 10 along with the agitation disc 11 is shown in section. A drive motor 17 is conventionally mounted on the support section 10 as by mounting screws 18 through holes 19 along with washers 20 and 21 and secured by conventional fastening means such as nuts 22. A partially threaded adapter 23 having a threaded section 24 is mounted directly on motor output shaft 25 as by a spring pin 26. An internally threaded knurled knob 27 with dampening o-ring 28 are used to secure the disc 11 to the threaded portion 24 of adapter 23.

Figure 2:
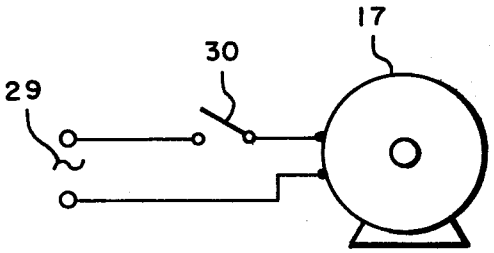
FIG. 2 is a schematic wiring diagram of a typical drive system.

FIG. 2 shows the simple wiring diagram of one method of operating the system of the invention wherein there is provided a source of normal alternating current 29 which is directly connected to the motor 17 through a conventional switch 30.

The disc 11 may be formed with any desired shaped recesses or combination of recesses and raised areas to correspond to the particular shape of the containers in which the fluid is to be mixed. The disc may be made of any conventional, moldable plastic or other desired material and, as can be seen from the exploded view of FIG. 3, different discs can be utilized with the same apparatus and simply removed and replaced as desired by removing the knurled knob 27.

The support member or casing structure 10 may also be made of any desired material, including molded fiberglass or suitable plastic material. Motor 17 illustrated in the preferred embodiment was a conventional gear motor such as a Series K86136 available from A. W. Haydon Company of Waterbury, Connecticut, which has an output speed of approximately 6 rpm. Of course, any conventional drive system, including one having adjustable or variable speeds, can be substituted for the drive illustrated in the preferred embodiment depending on the nature of the material being mixed and the size of the containers.

Thus, by means of the present invention the conventional apparatus utilized for the mixing of containers of such fluids as blood has been greatly simplified. Short and long tubes, such as those illustrated at 14 and 15 (FIG. 1), are easily removed and replaced on the agitating disc 11 by simply grasping same in the space between the recesses 12 and 13. This can be done easily while the disc 11 is rotating.

The embodiments of the invention in which an exclusive property or right is claimed are defined as follows:

1. An apparatus for the low speed agitation of fluids comprising:

rotatable agitating means, said agitating means further comprising, a disc-shaped member having a plurality of recesses in the surface thereof for receiving single containers of fluid to be agitated such that the normally vertically disposed axes of the containers are parallel to the plane of the disc and wherein said recesses are completely open above the plane of said disc such that said containers are retained solely by gravity therein and may be placed therein or removed therefrom during the rotation of said disc;

support means for supporting said agitating means at a position such that said containers are retained in said recesses by gravity; and drive means for rotating said disc means.

2. The apparatus of claim 1 wherein said containers are sealed test tubes.

3. The apparatus of claim 2 wherein said recesses are adapted to receive interchangeably a plurality of sizes of said tubes.

4. The apparatus of claim 1 wherein said disc is disposed at an angle between approximately 30° and approximately 60° with the horizontal.

5. The apparatus of claim 4 wherein said angle is 45°.

6. The apparatus of claim 1 wherein said recesses are generally radially disposed on said disk and integrally formed therein.

* * * * *